United States Patent [19]

Aberegg et al.

[11] 4,253,790

[45] Mar. 3, 1981

[54] CAR FOR CARRYING LARGE VESSELS

[75] Inventors: Richard E. Aberegg, Alliance; George H. Bell, Jr., Salem; Kendal B. Douglass; Lee R. Reed, Jr., both of North Canton, all of Ohio

[73] Assignee: United States Steel Corporation, Pittsburgh, Pa.

[21] Appl. No.: 745,329

[22] Filed: Nov. 26, 1976

[51] Int. Cl.[3] ..... B22D 11/10; B65G 65/34

[52] U.S. Cl. ..... 414/420; 187/19; 254/95

[58] Field of Search ..... 214/313, 314; 105/163, 105/164; 91/171; 141/232; 164/281; 74/422; 187/19; 254/95, 97; 414/419, 420, 421

[56] References Cited

U.S. PATENT DOCUMENTS

| | | | |
|---|---|---|---|
| 1,350,087 | 8/1920 | Trapp | 187/19 |
| 2,523,628 | 9/1950 | Nelson | 74/422 |
| 2,602,298 | 7/1952 | Ashton et al. | 91/171 |
| 3,241,458 | 3/1966 | Goldie | 91/171 |
| 3,405,032 | 10/1968 | Barrus et al. | 74/422 |
| 3,703,849 | 11/1972 | Renner et al. | 91/171 |
| 3,706,356 | 12/1972 | Herbst et al. | 187/8.59 |
| 3,844,429 | 10/1974 | Bode, Jr. et al. | 214/313 |
| 3,855,794 | 12/1974 | Meyer et al. | 91/171 |

FOREIGN PATENT DOCUMENTS

| | | | |
|---|---|---|---|
| 982543 | 1/1976 | Canada | 187/8.69 |

*Primary Examiner*—Lawrence J. Oresky
*Attorney, Agent, or Firm*—Walter P. Wood; William F. Riesmeyer

[57] ABSTRACT

A car for carrying large vessels, such as a tundish used in continuous casting, wherein the vessel is raised and lowered while supported on the car. The car embodies a raising-and-lowering mechanism which includes only two synchronized fluid-pressure cylinders, contrasted with the usual four cylinders or screw jacks. The cylinders transmit movement to the vessel through rack and pinion means.

8 Claims, 6 Drawing Figures

FIG. 3.
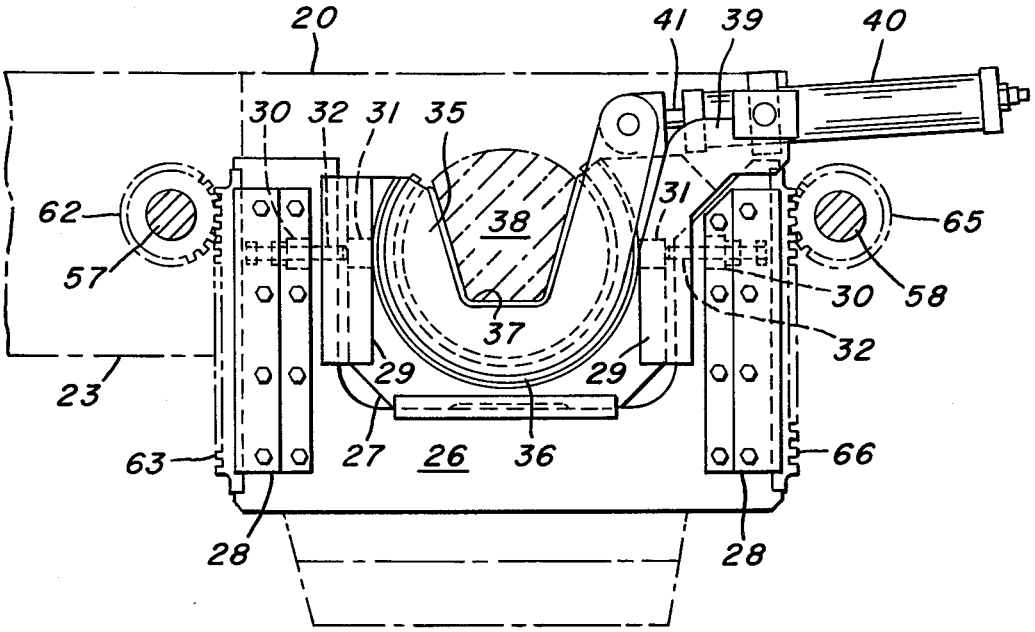
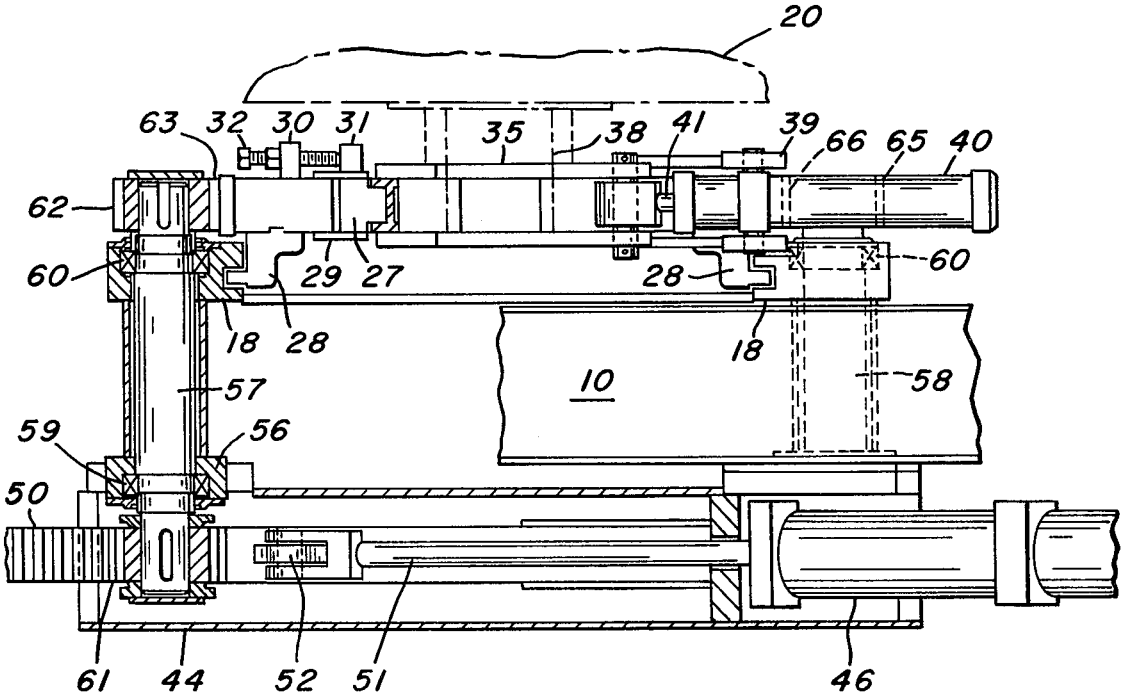
FIG. 4.

CAR FOR CARRYING LARGE VESSELS

This invention relates to an improved car for carrying large vessels which are required to be raised and lowered while supported on the car.

The invention is particularly useful when embodied in a car used for carrying a tundish in a continuous-casting installation. In the continuous-casting art, a tundish is an intermediate refractory lined vessel which receives liquid metal from a ladle and from which the metal is teemed into an open-ended mold. The tundish is carried into its teeming position or removed therefrom on a car which travels on rails on the casting floor. In many installations metal is teemed through a pouring tube as it goes from the tundish to the mold. The lower end of the pouring tube is submerged beneath the surface of the pool of metal in the mold. The tube must be replaced from time to time. Before replacing a tube while a casting operation is taking place, it is necessary to close the tundish outlet, and raise the tundish sufficiently that the tube clears the mold. After a new tube is installed, the tundish is lowered and teeming can resume. It is desirable also, although not essential, to be able to tilt the tundish to dump its contents at the end of a casting operation or in the event of a malfunction of the casting machine. Reference can be made to Bode et al U.S. Pat. No. 3,844,429 of common ownership for a showing of an earlier form of tundish car which performs these functions and over which the present invention is an improvement.

An object of our invention is to provide a car of the foregoing type which has an improved and simplified mechanism for raising and lowering a large vessel, such as a tundish, carried thereon.

A further object is to provide a tundish car which utilizes only two linear motion devices (e.g. hydraulic cylinders) for raising and lowering the tundish, contrasted with four cylinders or screw jacks used in the aforementioned earlier form, yet assures positively that all parts of the tundish moves uniformly as it is raised or lowered.

A more specific object is to provide an improved tundish car in which the mechanism for raising and lowering the tundish includes a pair of synchronized hydraulic piston and cylinder units, and rack and pinion means mechanically connecting the units with tundish-supporting saddle assemblies.

A further object is to provide an improved car which accomplishes the foregoing objects and optionally can be equipped with a mechanism for tilting a vessel carried thereon.

In the drawings:

FIG. 3 is a vertical section on line III—III of FIG. 1;

FIG. 4 is a horizontal section on line IV—IV of FIG. 5; and

ILLUSTRATIVE TUNDISH CAR

Figure 1:
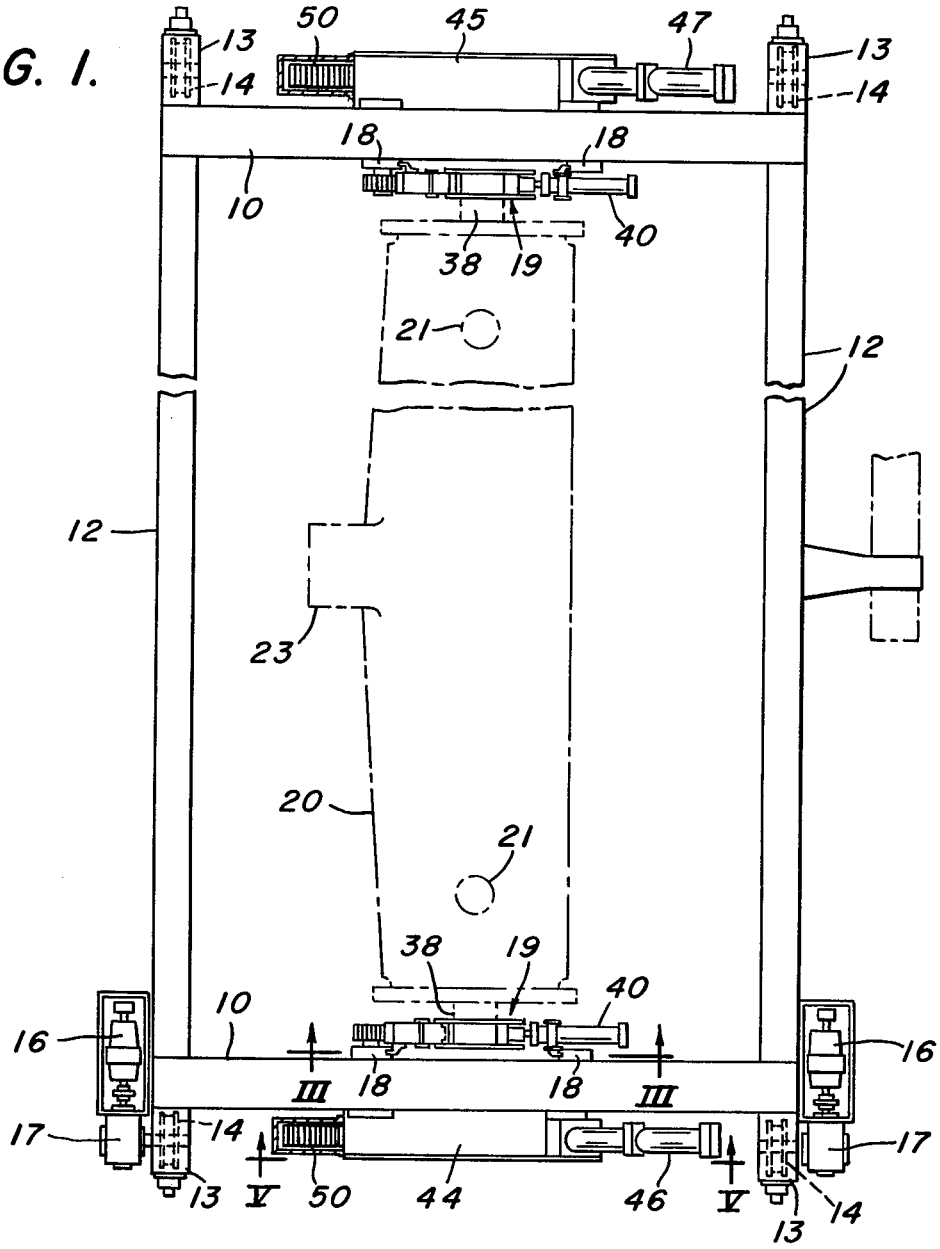
FIG. 1 is a top plan view of a tundish car embodying our invention.
Figure 2:
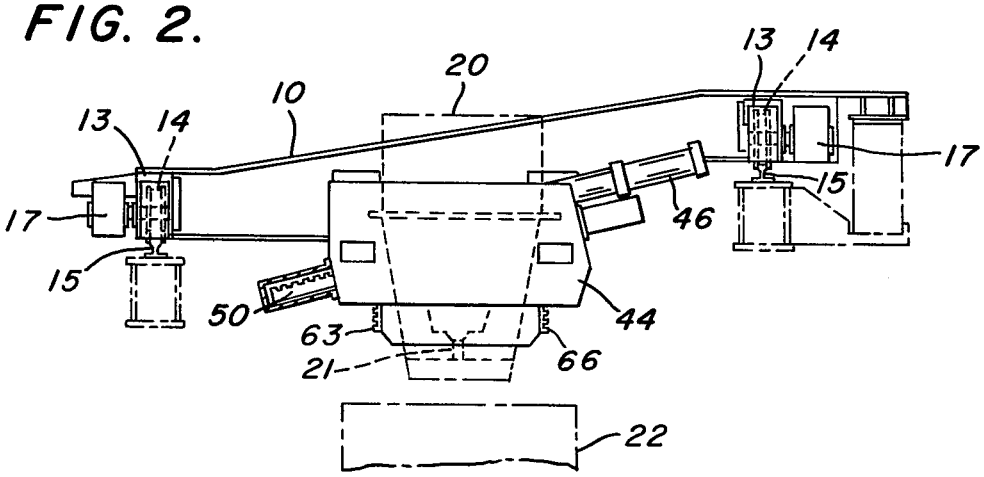
FIG. 2 is an end elevational view of the car.

For the purpose of illustrating our invention, we show in FIGS. 1 and 2 a tundish car which includes a frame formed of an opposed pair of transverse girders 10 and an opposed pair of lengthwise frame members 12 rigidly interconnected. The lengthwise frame members 12 carry fixtures 13 outboard of the transverse girders 10. Flanged wheels 14 are journaled in suitable bearings in fixtures 13 and ride on rails 15. Two wheels at opposite sides of the car are driven by motors 16 through gear reducers 17 to propel the car. The inboard faces of the girders 10 carry respective vertically extending guideways 18 in which saddle assemblies 19 are mounted for vertical movement. A tundish 20 is supported at its opposite ends in the two saddle assemblies. As shown diagrammatically, the tundish has outlets 21 in its bottom wall through which liquid metal may be teemed into one or more continuous casting molds 22. Preferably the tundish has an overflow 23 through which its contents may be dumped when the tundish is tilted. The parts of the car thus far described and the tundish are largely conventional and subject to many variations in their details.

SADDLE ASSEMBLIES

FIGS. 3 and 4 show the saddle assembly 19 at one end of the car in more detail. The saddle assembly at the other end is similar. The saddle assembly includes outer and inner nested U-shaped frames 26 and 27. The outer frame 26 carries guide members 28 at its outboard face received within the guideways 18. The inner frame 27 carries guide pieces 29 at its outside vertical edges. These guide pieces embrace the inside vertical edges of the outer frame 26. The outer frame carries lugs 30 which extend from its inboard face at the opposite arms of the U. The inner frame 27 carries cooperating abutments 31 on its inboard face. Adjustment screws 32 are threadedly engaged with lugs 30 and bear against the abutments 31 for adjusting the position of the inner frame 27 horizontally of the outer frame 26, and thus adjusting the position of the tundish 20 transversely of the car.

A saddle 35 is supported for rotation on a horizontal axis in an arcuate trackway 36 fixed within the inner frame 27. The saddle has a seat 37, and the tundish 20 has a trunnion 38 removably received in said seat. The guide pieces 29 at the side opposite the overflow 23 have upward extensions 39 to which a double-acting hydraulic "tilt" cylinder 40 is pivoted. The cylinder has a reciprocable piston and piston rod 41, the end of which is pivoted to the saddle 35 for tilting the tundish. The saddle may be constructed as shown in the aforementioned Bode et al patent and hence is not shown in detail here. If it is desired not to make the tundish tiltable, the structure may be simplified by omitting the tilting mechanism and supporting the trunnions directly on the inner frame 27.

TUNDISH RAISING AND LOWERING MECHANISM

Figure 5:
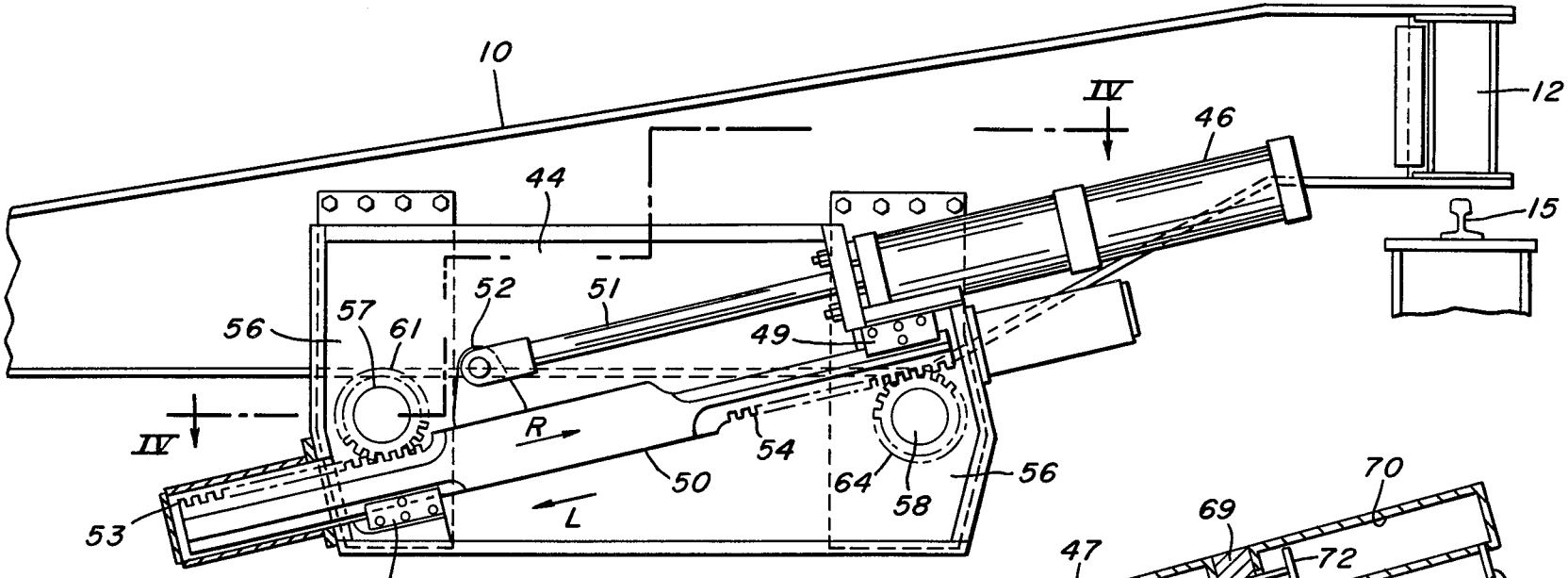
FIG. 5 is a vertical section on line V—V of FIG. 1.

In accordance with our invention, a pair of housings 44 and 45 are fixed to the respective transverse girders 10 at the outboard faces thereof. A pair of double-acting hydraulic "raise-and-lower" cylinders 46 and 47 are fixed to the respective housings. FIGS. 4 and 5 show the mechanism within the housing 44 at one end of the car in more detail. The mechanism at the other end is similar. Guide members 48 and 49 are fixed to inner wall of the housing and support a rack bar 50 for lengthwise movement. The cylinder 46 has a reciprocable piston and piston rod 51, the end of which is connected to a lug 52 on the rack bar. Top and bottom gear racks 53 and 54 are fixed to the rack bar adjacent its opposite ends.

As shown in FIG. 5, the transverse girder 10 carries a pair of depending supports 56. Parallel first and second pinion shafts 57 and 58 are journaled in outboard and inboard bearings 59 and 60 mounted in the supports 56 and guideways 18 respectively (FIG. 4). The first pinion shaft 57 carries a driven pinion 61 and a drive pinion 62. The driven pinion 61 lies within the housing 44 where it meshes with the top gear rack 53 on the rack bar 50. The drive pinion 62 meshes with a gear rack 63 fixed to the outside vertical edge of the outer frame 26 of the saddle assembly 19. Similarly the second pinion shaft 58 carries driven and drive pinions 64 and 65 which mesh with the bottom gear rack 54 on the rack bar 50 and with a gear rack 66 fixed to the opposite outside vertical edge of the outer frame 26, respectively. The rack bar is inclined to the horizontal, whereby the top gear rack 53 engages the pinion 61 near the bottom of the pinion, and the bottom gear rack 54 engages the pinion 64 near the top of the pinion. Thus the two pinion shafts 57 and 58 always rotate in opposite directions to transmit motion from the cylinders to the saddle assemblies.

HYDRAULIC CIRCUIT

Figure 6:
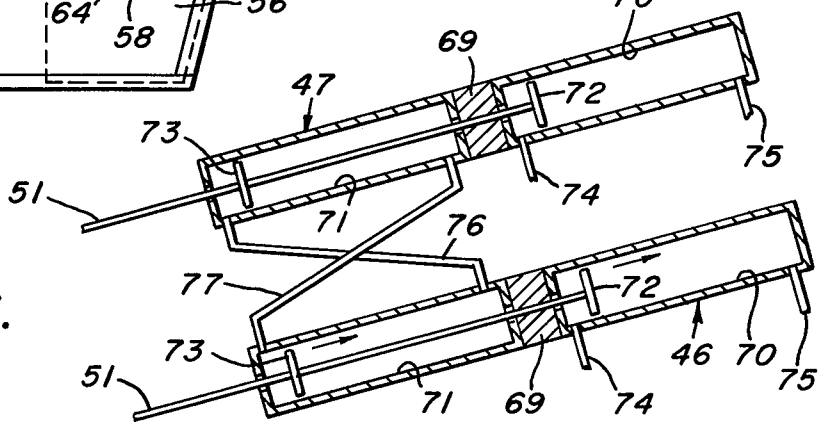
FIG. 6 is a schematic diagram of the preferred hydraulic circuit embodied in our mechanism.

FIG. 6 shows schematically the preferred hydraulic mechanism for actuating the "raise-and-lower" cylinders 46 and 47. Each cylinder has a respective partition 69 intermediate its length dividing it into a drive chamber 70 and a synchronizing chamber 71, which contain pistons 72 and 73 respectively. The piston rods 51 extend through the partitions 69 and are attached to both pistons 72 and 73. The drive chambers 70 of both cylinders have the usual connections 74 and 75 for admitting and discharging hydraulic fluid to drive pistons 72 in either direction. Respective pipes 76 and 77 connect each end of the synchronizing chamber 71 of the cylinder 46 with the opposite end of the synchronizing chamber of the other cylinder 47. This arrangement assures that the two cylinders remain synchronized and that the pistons of both always move through the same distance. A piston and cylinder unit of this type is available commercially from Hydropower Inc., Wadsworth, Ohio. Reference also can be made to Meyer et al U.S. Pat. No. 3,855,794 for a detailed showing.

OPERATION

When it is desired to raise the tundish 20, the "raise-and-lower" cylinders 46 and 47 are operated in synchronism to retract their piston rods 51 by equal distances, as explained in the description of the hydraulic circuit. The piston rods pull the rack bars 50 at each end of the car upwardly and to the right as viewed in FIG. 5. The top gear rack 53 rotates the pinion 61, shaft 57 and pinion 62 counterclockwise, while the bottom gear rack 54 rotates the pinion 64, shaft 58 and pinion 65 clockwise. Since the two drive pinions 62 and 65 engage gear racks 63 and 66 at opposite sides of the outer U-shaped frame 26, this frame and the inner U-shaped frame 27, and saddles 35 move upwardly. Thus the tundish 20, which rests on the saddles, likewise is raised. The parts move in the other direction to lower the tundish. The tundish descends under its own weight, while the cylinders 46 and 47 control the rate of descent.

From the foregoing description, it is seen that our invention affords a much simplified and less costly mechanism for raising and lowering a large vessel, such as a tundish, while the vessel is supported on a car. The mechanism assures that all parts of the vessel move up or down at the same rate and through the same distance and that the parts do not bind. At the same time this is accomplished with only two hydraulic piston and cylinder units.

We claim:

1. In a car for carrying a large vessel, which car includes a frame, a pair of saddle assemblies for supporting a vessel, and spaced apart means on said frame mounting said assemblies for vertical movement with respect to said frame, the combination therewith of an improved mechanism for raising and lowering said assemblies, said mechanism comprising a pair of fluid-pressure cylinders mounted on said frame at spaced apart locations, rack and pinion means mechanically connecting said cylinders with the respective assemblies to transmit motion from the cylinders to the assemblies, said rack and pinion means including respective rack bars mounted on said frame for lengthwise movement, top and bottom gear racks carried by said bars, means connecting said bars with the respective cylinders, gear racks carried by said assemblies at opposite sides thereof, pairs of pinion shafts journaled to said frame adjacent each assembly, driven pinions carried by said shafts meshing with the gear racks on said bars, and drive pinions carried by said shafts meshing with the gear racks on said assemblies, and means inter-connecting said cylinders for synchronizing the motion transmitted by the two cylinders.

2. A mechanism as defined in claim 1 in which the two pinion shafts of each pair rotate in opposite directions to raise or lower said assemblies.

3. A mechanism as defined in claim 1 in which each of said assemblies includes respective outer and inner nested U-shaped frames, means for adjusting the position of said inner frames horizontally with respect to said outer frames, respective saddles on said inner frames each for carrying one end of a vessel, and gear racks on the outside edges of said outer frames forming part of said rack and pinion means.

4. A mechanism as defined in claim 3 comprising in addition means on said U-shaped frames connected with the saddles for tilting a vessel carried by said saddles.

5. A tundish car comprising a frame, a pair of saddle assemblies for supporting a tundish, spaced apart means at opposite ends of said frame mounting said assemblies for vertical movement with respect to said frame, a pair of fluid pressure cylinders mounted on said frame adjacent opposite ends thereof, rack and pinion means mechanically connecting said cylinders with the respective assemblies at each side of each assembly, said rack and pinion means including respective rack bars mounted on opposite ends of said frame for lengthwise movement, top and bottom gear racks carried by said bars, means connecting said bars with the respective cylinders, gear racks carried by each of said assemblies at each side thereof, pairs of pinion shafts journaled to said frame at each end thereof, driven pinions carried by said shafts meshing with the gear racks on said bars, and drive pinions carried by said shafts meshing with the gear racks on said assemblies, and synchronizing means interconnecting said cylinders whereby two cylinders transmit motion to two assemblies at each side of each assembly to raise or lower the assemblies uniformly.

6. A car as defined in claim 5 in which said cylinders and said rack bars are inclined to the horizontal, said top gear racks engage the driven pinions near the bottom of the pinions, and said bottom gear racks engage the driven pinions near the top of the pinions, whereby the pinion shafts of each pair rotate in opposite directions.

7. A car as defined in claim 5 in which each of said assemblies includes respective outer and inner nested U-shaped frames, means for adjusting the position of said inner frames horizontally with respect to said outer frames, respective saddles on said inner frames each for carrying one end of a tundish, and gear racks on the outside edges of said outer frames forming part of said rack and pinion means.

8. A car as defined in claim 7 comprising in addition means on said U-shaped frames connected with the saddles for tilting a tundish carried by said saddles.

* * * * *